US005535236A

United States Patent [19]

Fischer

[11] Patent Number: 5,535,236

[45] Date of Patent: Jul. 9, 1996

[54] PREHEATING DEVICE

[75] Inventor: Werner Fischer, Venthöne, Switzerland

[73] Assignee: Maschinenfabrik Gustav Eirich, Germany

[21] Appl. No.: 235,487

[22] Filed: Apr. 29, 1994

[30] Foreign Application Priority Data

May 10, 1993 [CH] Switzerland ..... 01431/93

[51] Int. Cl.[6] ..... H05B 7/09

[52] U.S. Cl. ..... 373/89; 373/88; 204/294; 219/388; 432/235

[58] Field of Search ..... 373/88, 89, 90, 373/92, 111, 128, 123; 432/116, 235; 204/294; 219/388

[56] References Cited

U.S. PATENT DOCUMENTS 4,431,503 2/1984 Withers et al. ..... 204/294

*Primary Examiner*—Tu Hoang
*Attorney, Agent, or Firm*—Paul & Paul

[57] ABSTRACT

The invention relates to an electrically operated preheater for dry material for the manufacture of green carbon-containing masses. The invention includes a preheater having a silo housing, a core, a top and a bottom electrode, a concentric feed pipe, an eccentric feed pipe, and a rotating feeding tool. The silo housing has a core located substantially within the silo housing extending substantially along its longitudinal axis. The top electrode is provided between the wall of the silo housing and the core, located proximate the top end of the silo housing, and the bottom electrode is provided between the wall of the silo housing and the core, located proximate the bottom end of the silo housing. The electrodes are connected to a power source. The rotating removal tool is located in the core proximate the eccentric feed pipe. The rotating feeding tool conveys the material for manufacture from the core into the eccentric feed pipe.

8 Claims, 2 Drawing Sheets

PREHEATING DEVICE

BACKGROUND OF THE INVENTION

The invention relates to a device for preheating dry materials according to the preamble of claim 1.

Masses for manufacture of electrodes (anodes, cathodes) for aluminium production by molten electrolyte electrolysis are composed of dry materials—dry materials are mixtures of petrol coke and granulated electrode scrap -, to which pitch is added as a binder directly before shaping. Masses with this composition are also called green masses, the electrodes are formed from them and subsequently baked. In order to admix the binder, the dry material has to be heated, in relation to which the term preheating is used, which takes place in so-called preheaters, into one end of which dry material is conveyed by means of weigh-feeders, the conveyed material is heated in the preheater and from the other end of which the heated dry material is removed in the direction of mixers. As preheaters, heating screws, heating silos and heating drums are known. The invention has a heating silo as subject-matter.

A heating silo—they are termed batch preheaters in the technical terminology—is known, in which the dry material is preheated by electrical resistance heating. In the interior of the preheater several electrodes are provided, arranged one below the other—penetrating the walls of the preheater in an insulated manner—for the initiation and discharge of the current (direct or alternating current) flowing through the dry material and thereby heating it. The known device is polygonal in plan view and is characterised by an inhomogeneous mass flow and irregular heating, which leads to graphitisation of the unremoved mass on the electrodes and burning through of the insulation. These disadvantages are increased by the arrangement of preheaters in installations for manufacturing green masses, so that the arrangements are affected to the extent that the repair of a preheater brings entire manufacturing installations to a standstill.

SUMMARY OF THE INVENTION

Proceeding from this, the inventor's object is to provide a preheater of the type presently described, in which dry material is evenly heated by a homogeneous mass flow, and the object is solved by means of the characterising features of claim 1. The invention additionally includes the arrangement of two preheaters in such a way that repairs are possible involving the shortest possible standstill time for the whole installation.

The invention is advantageously further developed through the subject matter of the claims following claim 1.

BRIEF DESCRIPTION OF THE DRAWINGS

Further advantages, features and details of the invention will be shown in the following description of a preferred embodiment and the drawings. In these:

FIG. 1 schematically shows two preheaters 10, 11, which are arranged on a rack 12. The preheater 10 is arranged beneath a continuously operating balance 13 and above a continuously operating mixer 14. By means of feed pipes 19 and 20, the preheater 10 and the mixer 14 are supplied via the balance 13. In FIG. 1 the preheater 10 is connected to a rectifier 15 by means of electrodes 16, 17 and a connection cable 18. Preheaters 10 and 11 are arranged on a horizontal rack 12, which is formed so that it is rotatable by 360° about a vertical axis of rotation 19. If repairs to the preheater 10 become necessary, the rectifier 15 can be disconnected (releasing the connection cable 18), the rack 12 can be rotated by 180°, so that the preheater 11 is conducted under the balance 13 and over the mixer 14, and the connecting cable 18 reconnected to the electrodes 16, 17 (parts of the same type and with the same function are designated with the same reference numerals) and the preheater 11 put into service. With this possibility of bringing in a substitute preheater (either 10 or 11) the time taken by interruptions to operations can be reduced to a minimum.

FIG. 2 shows preheaters 10 (in operation) and 11 (ready for use) according to the invention. The preheaters 10 and 11 are formed identically, so that the description is confined to preheater 10.

Figure 1:
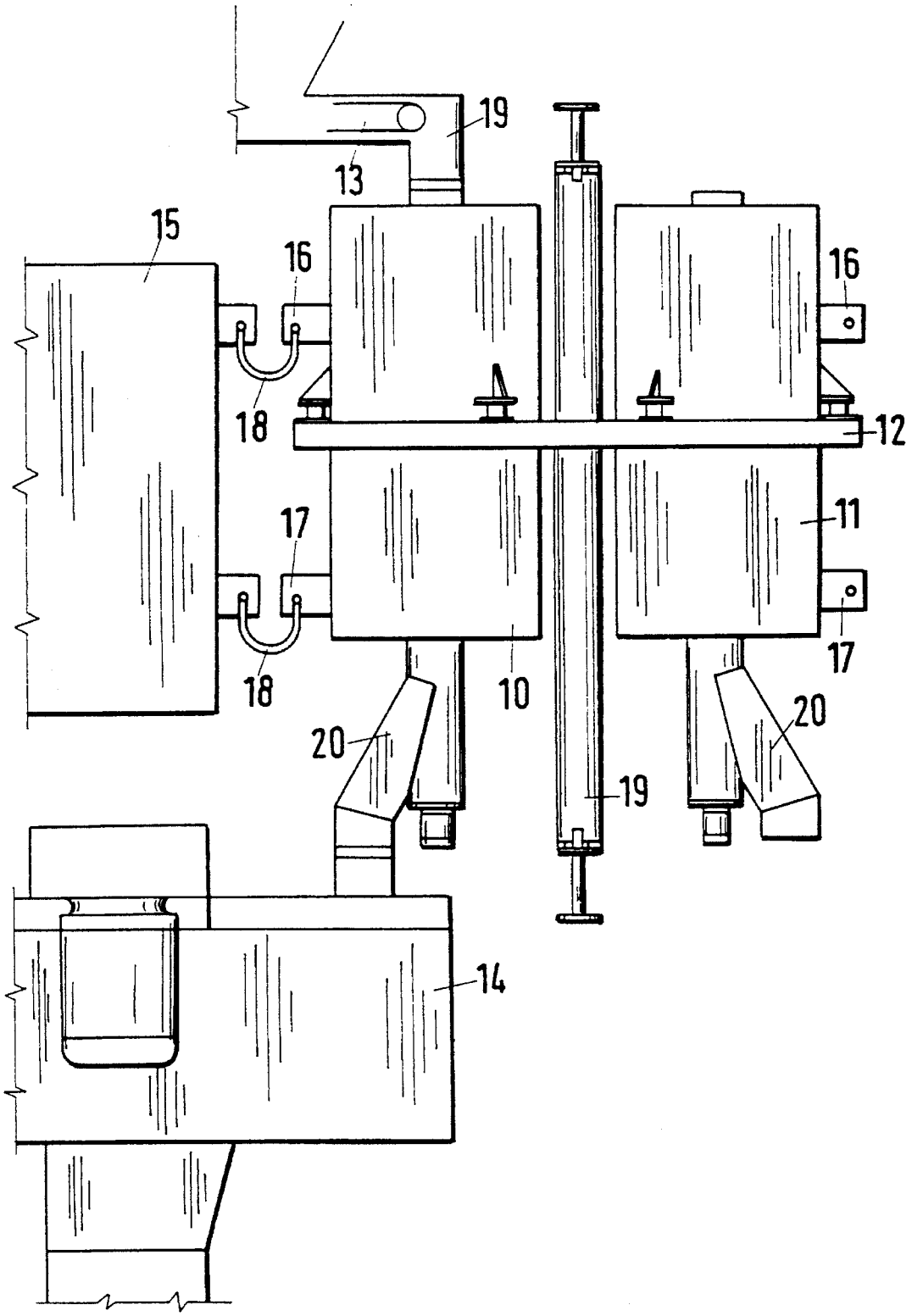
FIG. 1 shows a schematic representation of a preheater between a balance and a mixer, connected to a rectifier.

The preheater 10 according to the invention is composed of a round hollow body 22, hereafter also called silo housing 22, which is formed from rings 23 concentrically arranged above one another (in the instance shown, six rings 23).

The concentricity is ensured by steps 24, 25 arranged on the end face, which by fitting inside one another centre the rings 23 with respect to one another, so that there is a steplessly round inside surface 26 and outside surface 27 of the silo housing 22. The rings 23 forming the silo housing 22 are composed of a heat resistant, non electrically conductive ceramic material, for example a heat resistant concrete (by heat resistant, resistance of up to 500° C. is to be understood). The silo housing 22 composed of ceramic material is concentrically surrounded at a distance by a metallic cover pipe 28, which is kept equidistantly apart on all sides from the silo housing 22 by supports 29. The space 30 which is thus formed between the silo housing 22 and the metallic cover pipe 28 is also useful for insulation purposes.

At the top end, that is, in the direction facing the balance 13, the silo housing 22, the space 30 and the cover pipe 28 are closed by a removable lid 31, which has a central opening 32 for further conveying the dry material coming from the feed pipe 19 into the silo housing 22. At the bottom end, that is in the direction of flow of the dry material towards the direction of the mixer, the silo housing 22 is likewise closed by a lid 33 with an opening 33*a*, into which the feed pipe 20 opens out.

Concentrically inside the silo housing 22 and rectified with respect thereto there is a round core 34. The core 34 is composed of rings 35 which are arranged on top of one another and held together by means of a tie rod 36 and an anchor plate 36*a*.

Between the interior peripheral wall of the silo housing 22 and the external periphery of the core 34 there remains an annular space 37, which is fed from the top end by a distribution cone 38 on the core 34, uniformly on all sides with the mixture, wherein for this purpose, the point 39 of the distribution cone 38 is arranged concentrically with respect to the opening 32. The rings 35 are composed of a same ceramic substance as the rings 23 of the silo housing 22. At the top end, from the annular space 37 there protrude internal electrodes 41 affixed to one or, as shown in the present embodiment, two rings 23. Two internal electrodes 41 are shown lying radially opposite each other, holding the core 34 between them. In fact, in the internal periphery there are several such electrodes 41 distributed regularly, reaching through the annular space 37 as far as the core 34, wherein these electrodes 41 are electrically conductive, that is connected together by conduction of a current. The upper electrode 16 which is connected to the rectifier 15 reaches through (insulates) the cover pipe 28, the air space 30 and closes rings by reaching through to an inner electrode 11 or to the device for electrical connection of the inner electrodes 41. The concentric and axial mounting of the core 34 in the silo housing 22 can, with respect to the concentricity be done by means of the inner electrodes 41, the axial mounting could be carried out by a metallic ring 42 fixed to the top end of the core 34 and by means of a shoulder 40 lying on the inner electrodes 41, which could also serve as an electrical connection for the inner electrodes.

At the bottom end in the silo housing 22, inner electrodes 43 are provided with the same construction and in the same arrangement, which are electrically conductively connected to a lower electrode 17, which is also connected to the rectifier 15.

Figure 2:
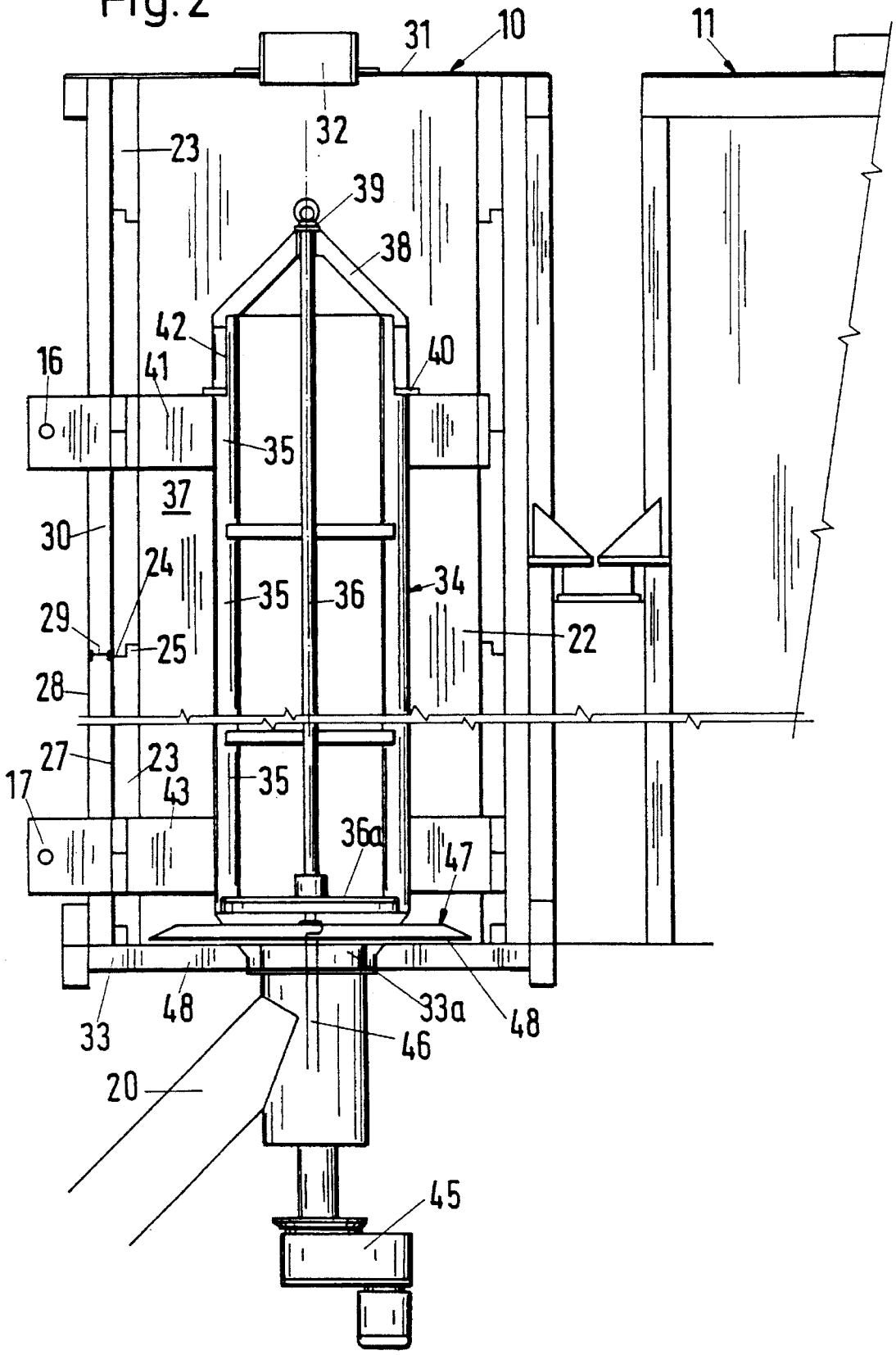
FIG. 2 shows in section a preheater according to the invention with a second, schematically drawn in a revolver arrangement.

FIG. 2 shows a drive unit, designated 45, which, with a drive shaft 46 which penetrates the cover 33 drives a removal tool 47 rotating between the tie rod plate 36*a* and the cover 33. The removal tool 42 is composed of a star of several circularly curved arms 48 (not shown in the plan view), which remove dry material and convey the removed material into the feed pipe 20 which opens out eccentrically into the lid 33.

The method of functioning of the device according to the invention is briefly summarised as follows. Dry material arriving from the balance 13 into the annular space 37 through the opening 32 is furthered by the distribution cone 37 evenly into the annular space 37. In the annular space 37 there is a column of dry material in the form of a ring-shaped tube, externally delimited by the internal diameter of the silo housing 22 and internally by the external diameter of the core 34. The removal tool 47 continuously removes the dry material from the bottom end and conveys it via the feed pipe in the direction of the mixer 14, so that the dry material travels evenly from the top to the bottom. During this travel it is flowed through in an axial direction by current going from the upper electrodes 41 to the bottom electrodes 43, and, because of the prevailing electrical resistances of the dry material, is heated up to 300° C., wherein this temperature, as any other, can be regulated by +/−2° C. From this it is obvious that the device according to the invention ensures a homogeneous mass flow of evenly heated dry mass, and along with this the known disadvantages of the state of the art are eliminated.

I claim:

1. A device for electrical preheating of a dry material for manufacture of green masses for electrodes comprising a silo housing, a core, a top and a bottom electrode, a concentric feed pipe, an eccentric feed pipe, and a rotating removal tool, said silo housing having a top end, a bottom end, a circumferentially extending wall, and a longitudinal axis, said core located substantially within said silo housing extending substantially along said longitudinal axis to define a hollow annular space, said top electrode provided between said wall of said silo housing and said core, located proximate said top end of said silo housing, and said bottom electrode provided between said wall of said silo housing and said core, located proximate said bottom end of said silo housing, said electrodes connected to a power source, said concentric feed pipe located proximate said top end for feeding said dry material into said annular space, said eccentric feed pipe located proximate said bottom end, said rotating removal tool located in a lower end of said annular space proximate said eccentric feed pipe, wherein said rotating removal tool provides a means to convey said material for manufacture from the annular space into said eccentric feed pipe.

2. The device of claim 1, wherein the silo housing is composed of rings arranged concentrically above one another, of ceramic, electrically non-conductive material.

3. The device of claim 2, wherein the rings are maintained in a concentric position by steps.

4. The device of any one of claims 1, 2 or 3, wherein the silo housing is surrounded by a cover pipe, distanced therefrom by supports.

5. The device of any one of claims 1, 2 or 3, wherein the top electrode establishes the concentric position of the core with respect to the silo housing and a metal ring fixed to the top end of the core places the core along the longitudinal axis of the silo housing.

6. The device of any one of claims 1, 2 or 3, wherein the top and bottom electrodes are connected to a current supply by means of the upper electrode.

7. The device of any one of claims 1, 2 or 3, wherein the rotating removal tool is composed of a star of a plurality of circularly curved arms.

8. A device for electrical preheating of a dry material for manufacture of green masses for electrodes comprising at least two preheaters, each preheater comprising a silo housing, a core, a top and a bottom electrode, a concentric feed pipe, an eccentric feed pipe, and a rotating removal tool, said silo housing having a top end, a bottom end, a circumferentially extending wall, and a longitudinal axis, said core located substantially within said silo housing extending substantially along said longitudinal axis to define an annular space, said top electrode provided between said wall of said silo housing and said core, located proximate said top end of said silo housing, and said bottom electrode provided between said wall of said silo housing and said core, located proximate said bottom end of said silo housing, said electrodes connected to a power source, said concentric feed pipe located proximate said top end for feeding said dry material into said annular space, said eccentric feed pipe located proximate said bottom end, said rotating removal tool located in said annular space proximate said eccentric feed pipe, wherein said rotating removal tool located in said annular space conveys said material for manufacture from the annular space into said eccentric feed pipe, said preheaters mounted on a horizontal rack, said rack formed so that it is rotatable about a vertical axis of rotation located between said preheaters.

* * * * *